US007396036B2

(12) United States Patent
Barbieri et al.

(10) Patent No.: US 7,396,036 B2
(45) Date of Patent: Jul. 8, 2008

(54) GLIDING BOARD WITH VARYING BENDING PROPERTIES

(75) Inventors: Scott Barbieri, Middlebury, VT (US); Peter J. Bergendahl, Winooski, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 10/997,425

(22) Filed: Nov. 24, 2004

(65) Prior Publication Data

US 2005/0073132 A1 Apr. 7, 2005

Related U.S. Application Data

(63) Continuation of application No. 09/755,513, filed on Jan. 5, 2001, now abandoned.

(51) Int. Cl.
*A63C 5/04* (2006.01)

(52) U.S. Cl. ..... 280/601; 280/602; 280/608; 280/14.22

(58) Field of Classification Search ..... 280/601, 280/602, 608, 609, 610, 14.21, 14.22
See application file for complete search history.

(56) References Cited

U.S. PATENT DOCUMENTS

| | | | |
|---|---|---|---|
| 3,599,259 | A | 8/1971 | Shewmon |
| 3,655,211 | A | 4/1972 | Bolletieri et al. |
| 3,705,729 | A | 12/1972 | Arnsteiner |
| 3,758,127 | A | 9/1973 | Doyle |
| 3,801,117 | A | 4/1974 | Pierce |
| 3,854,739 | A | 12/1974 | Toda |
| 3,900,204 | A | 8/1975 | Weber |
| 3,933,360 | A | 1/1976 | Arai |
| 3,947,049 | A | 3/1976 | Pederson |
| 4,382,610 | A | 5/1983 | Arnsteiner |
| 4,455,037 | A | 6/1984 | Pilpel et al. |
| 4,498,686 | A | 2/1985 | Pilpel et al. |
| 4,545,597 | A | 10/1985 | Meatto et al. |
| 4,671,529 | A | 6/1987 | LeGrand et al. |
| 4,861,063 | A | 8/1989 | Abondance |

(Continued)

FOREIGN PATENT DOCUMENTS

| | | |
|---|---|---|
| CA | 989 435 | 5/1976 |

(Continued)

OTHER PUBLICATIONS

Supplementary Issue *Ski Journal* "Ski Selection 98", Ski Journal Publisher Inc., Published on Nov. 1, 1997, p. 254.

*Primary Examiner*—Christopher Ellis
*Assistant Examiner*—Brian Swenson
(74) *Attorney, Agent, or Firm*—Wolf, Greenfield & Sacks, P.C.

(57) ABSTRACT

A gliding board, such as a snowboard, has improved lift or float in certain conditions, e.g., when gliding in powdered snow. A nose and/or tail of the gliding board may have a variable bending property to provide the improved float. In one embodiment, the nose and/or tail may have a tapered thickness or other features so that the nose and/or tail is more flexible toward the tip of the nose or tail. Other variable bending properties in the nose and/or tail may be provided for reasons other than improved float, such as to enhance trick or other maneuver performance.

28 Claims, 3 Drawing Sheets

U.S. PATENT DOCUMENTS

| | | | | |
|---|---|---|---|---|
| 4,867,470 | A | | 9/1989 | Clark |
| 4,953,884 | A | | 9/1990 | Diard et al. |
| 4,961,592 | A | | 10/1990 | Diard et al. |
| 4,971,350 | A | | 11/1990 | Fagot |
| 5,002,300 | A | | 3/1991 | Pascal et al. |
| 5,108,124 | A | | 4/1992 | Pascal et al. |
| 5,135,249 | A | | 8/1992 | Morris |
| 5,160,158 | A | | 11/1992 | Scherubl |
| 5,242,187 | A | | 9/1993 | Diard et al. |
| 5,292,146 | A | | 3/1994 | Palau |
| 5,292,148 | A | | 3/1994 | Abondance et al. |
| 5,320,378 | A | | 6/1994 | Wiig |
| 5,366,234 | A | | 11/1994 | Rohrmoser |
| 5,372,370 | A | | 12/1994 | Rohrmoser |
| 5,496,053 | A | | 3/1996 | Abondance |
| 5,538,272 | A | | 7/1996 | Peart |
| 5,553,884 | A | | 9/1996 | Abondance |
| 5,599,036 | A | | 2/1997 | Abondance et al. |
| 5,690,349 | A | | 11/1997 | Rohrmoser |
| 5,725,236 | A | | 3/1998 | Stephanova et al. |
| 5,788,259 | A | | 8/1998 | Emig |
| 5,803,478 | A | | 9/1998 | Gavalis |
| 5,816,590 | A | | 10/1998 | Fey et al. |
| 5,836,594 | A | | 11/1998 | Simmons |
| 5,851,331 | A | | 12/1998 | Grenetier et al. |
| 5,871,223 | A | | 2/1999 | Zanco |
| 5,871,224 | A | | 2/1999 | Vance |
| 5,895,067 | A | | 4/1999 | Stephanova et al. |
| 5,915,717 | A | | 6/1999 | Faye |
| 5,921,564 | A | | 7/1999 | Olson |
| 5,924,718 | A | | 7/1999 | Gordon et al. |
| 5,954,356 | A | | 9/1999 | Busby, Jr. et al. |
| 5,984,343 | A | * | 11/1999 | Longoni et al. ..... 280/602 |
| RE36,453 | E | | 12/1999 | Abondance et al. |
| 6,000,711 | A | | 12/1999 | Fey et al. |
| RE36,586 | E | | 2/2000 | Abondance et al. |
| 6,073,954 | A | | 6/2000 | Guiguet et al. |
| 6,105,991 | A | | 8/2000 | Dodge |
| 6,113,126 | A | | 9/2000 | Zanco |
| 6,402,182 | B1 | | 6/2002 | Noviant |

FOREIGN PATENT DOCUMENTS

| | | | |
|---|---|---|---|
| DE | 2 820 382 | | 5/1978 |
| DE | 4 101 915 | | 1/1991 |
| DE | 4 205 356 | A1 | 2/1992 |
| EP | 610660 | | 4/1997 |
| EP | 0 785 000 | | 7/1997 |
| JP | 822 9184 | | 9/1996 |
| JP | 8-318020 | | 12/1996 |
| WO | WO 99/25433 | | 5/1999 |
| WO | WO 99/46016 | | 9/1999 |
| WO | WO 02/13923 | A1 | 2/2002 |

* cited by examiner

GLIDING BOARD WITH VARYING BENDING PROPERTIES

This application is a continuation of U.S. application Ser. No. 09/755,513, filed Jan. 5, 2001 now abandonded.

FIELD OF THE INVENTION

The present invention relates generally to a gliding board and, more particularly, to a gliding board with varying bending properties.

BACKGROUND OF THE INVENTION

Specially configured boards for gliding along a surface are known, such as snowboards, snow skis, water skis, wake boards, surfboards and the like. For purposes herein, "gliding board" refers generally to any of the foregoing boards as well as to other devices which allow a rider to traverse a surface. For ease of understanding, however, and without limiting the scope of the invention, aspects of the invention are discussed below particularly in connection with a snowboard.

A typical snowboard includes a running length extending between opposite nose and tail ends. The nose and tail ends may have a "shovel" shape where the board end curves upwardly generally avoiding contact with the snow when riding on smooth terrain. The location at which the ends curve upward and away from the running length of the board is commonly called a transition or contact area.

The nose and/or tail provide an important function when riding over curved or bumpy surfaces, and when riding in deep snow. When riding on curved or bumpy surfaces, the nose and/or tail can prevent the leading end from digging into the curve or bump, and instead allow the board to glide up a curve or over a bump. When riding in deep snow, the leading end of the snowboard (usually the nose) is upturned and contacts the snow so that the board does not dive under the snow surface. That is, the upturned nose forces snow under the board and keeps the board from sinking excessively into the snow. This ability of the board to force a proper amount of snow under the board and keep the rider at a suitable position relative to the surface of deep snow is commonly called "float." To improve float in deep snow, some cap-type construction boards have been provided with a core that has a tapered thickness at the nose. This tapered thickness of the core results in a cap-type board having a nose that increases in flexibility from the transition or contact area toward the tip of the nose. This increased flexibility allows the nose to flex upward to a varying degree along the nose when contacted by snow, thereby increasing the frontal area on the nose and the amount of lift provided to the board.

A cap-type snowboard is typically constructed from several components including a core, e.g., made of wood, top and bottom reinforcing layers that sandwich the core, a top cosmetic layer and a bottom gliding surface, or base. The top reinforcing layer typically overlaps the side edges of the core to protect the core from the environment and provide structural support to the board. Since the core in a cap-type board typically extends into the nose and tail ends of the snowboard, tapering the core at the nose end results in a board having a tapered nose and improved float.

Another construction type of snowboard is the sidewall-type board. Similar to a cap board, sidewall boards typically have a core, top and bottom reinforcing layers, a top cosmetic layer and a bottom gliding surface. However, in contrast to cap boards, the top reinforcing layer does not cover the side edges of the core. Instead, a sidewall support member is positioned between the top and bottom reinforcing layers (and/or a metal edge at the bottom of the board). The sidewall is bonded to the top and bottom layers to protect the interior of the board, including the core, from the environment. The core in sidewall boards does not normally extend into the nose and tail ends of the board. Instead, the core terminates near the transitions at the nose and tail, and a spacer made from a flat sheet material is positioned between the top and bottom reinforcing layers in the nose and tail. The spacer typically has a constant thickness and forms a significant portion of the thickness of the nose and tail ends. Thus, prior sidewall-type boards have not been provided with a tapered nose or other features to improve the float of the board.

SUMMARY OF THE INVENTION

One illustrative embodiment in accordance with the invention provides a gliding board for traveling over powder or soft snow with increased lift or float. The gliding board includes a running length that extends into opposite ends, two edges and a sidewall extending along at least a portion of one edge of the running length. A nose is located at one end of the board, and a tail is located at the other end. The nose and tail each have a transition end near the running length and a tip end opposite the transition end. At least one of the nose and tail has varying bending properties to provide improved float of the board. For purposes herein, "bending properties" refers to a property such as the flexibility, bending modulus, flexural rigidity or any other bending property that may be varied over a span of the nose or tail. For example, the varying bending properties may include a flexibility of the nose or tail that changes over the nose or tail. The bending properties of the nose or tail may vary in any suitable way.

In another illustrative embodiment, a snowboard, adapted to cooperate with a pair of foot bindings that secure a rider's feet to the snowboard, includes a running length having two side edges extending between forward and rear transitions. The running length has a sidewall extending over at least a portion of the side edges. An upturned nose is positioned at the forward transition and has a transition end and a tip end. The nose has a cap construction and a flexibility that varies between the transition end and the tip end.

In another illustrative embodiment, a method of manufacturing a gliding board having a running length and an upturned nose joined to the running length at a transition includes providing a core constructed and arranged for incorporation into a gliding board. The core has top and bottom surfaces and lateral sides. At least one sidewall element, a top reinforcement layer and a bottom reinforcement layer are also provided, and the top reinforcement layer, the bottom reinforcement layer, the at least one sidewall and the core are assembled together. The gliding board is assembled so that (i) the top and bottom reinforcement layers are on opposite top and bottom surfaces of the core, (ii) the at least one sidewall element is secured along a lateral side of the core, and (iii) the nose has varying bending properties.

In another illustrative embodiment, a gliding board includes a running length formed, at least in part, with a sidewall construction, and an upturned nose located at one end of the running length. The nose includes means for providing the nose with a varying bending property.

These and other aspects of the invention will be appreciated from the following description and claims.

BRIEF DESCRIPTION OF THE DRAWINGS

It should be understood that the drawings are provided for the purpose of illustration only and are not intended to define the limits of the invention. Various aspects of the present invention will become apparent with reference to the following detailed description taken in conjunction with the accompanying drawings in which.

DETAILED DESCRIPTION

Figure 1:
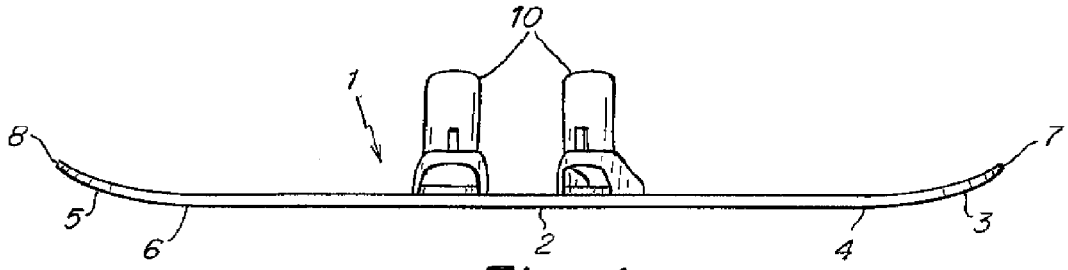
FIG. 1 is a side view of a gliding board comprising a nose having varying bending properties in accordance with one aspect of the invention.

In one illustrative embodiment in accordance with the invention, a nose or tail of a sidewall constructed gliding board is configured with varying flex properties to affect the float or lift performance of the board in deep snow or powder. For example, the gliding board may have a sidewall construction along a portion of the running length of the board, and a cap construction at the nose and/or tail with a varying bending property, e.g., flexibility, in either the nose or tail. The bending properties may vary in any direction within the nose or tail, and may vary linearly, non-linearly, continuously, in a step-wise manner, or in any suitable manner. Thus, the bending property of the nose or tail may vary longitudinally and/or laterally, providing desired lift or float characteristics when gliding, particularly in powder or soft snow, since the nose or tail may flex when contacting snow or other material to present an increased surface area. A hybrid sidewall/cap construction of the board can provide some of the desired characteristics of an all sidewall construction board, such as easier repair, resistance to damage at the edges, and improved shock absorption, while also providing some of the advantages of a cap-type construction, such as simplified manufacturing techniques, improved responsiveness of the board in turning, etc.

In one illustrative embodiment, at least one end (nose or tail) of the board may be more flexible near the tip than near the transition to the running length of the board. The more flexible tip of the end may bend to provide a greater surface area against which the snow or other material may impact and force snow to travel under the board. For example, the increased surface area created by flexing may increase the force of snow or other material urging the end upward during gliding, thereby increasing the lifting force on the board. The stiffer portion of the nose or tail near the transition to the running length may resist large amounts of bending and more directly and effectively transfer force of the snow on the more flexible tip end to the running length of the board.

In one illustrative embodiment, the board nose and/or tail includes a structural element that has at least one feature to provide the nose and/or tail with varying bending properties. For example, the structural element may be a part of the board core or any other single constituent part or material, or group of parts or materials, in the nose or tail. The features of the structural element that provide the varying bending properties can include a tapering in thickness of the element, grooves, holes or other physical features formed in the element, a change in material or material properties in the element or any other suitable features. For example, the material type or density of the core or the reinforcing layers may be varied over the areas of the nose and tail, or varying amounts or types of reinforcement fibers or embedded materials may be added to the core in different areas to change the local bending properties of the nose and tail. The bending properties may also be varied by controlling the amount or type of adhesives used to attach the various layers of the board.

In one illustrative embodiment, an end (nose or tail) of the board decreases in overall thickness from near the transition toward the tip. For example, in one embodiment, the nose may taper approximately 1 mm in thickness over an approximately 150 to 200 mm length. This taper in overall thickness may result in increased flexibility of the end, e.g., to allow the end to flex further upwards when gliding in deep snow. The thickness of the nose or tail near the transition may not be needed over the entire area of the nose or tail and thus, the thickness may taper because the nose and tail typically experience less stress closer to the tip. A decreasing thickness in the nose or tail may give the board the required structural integrity while allowing an increased and/or differential flexibility in the nose or tail. The tapering thickness may be formed in any suitable way. For example, the board core may taper at the nose or tail, or the core may have a constant thickness and other board components may vary in thickness. The thickness of the core and/or board may vary in the lateral direction instead of, or in combination with, the longitudinal direction to provide varying flexibility in a lateral direction.

Figure 7:
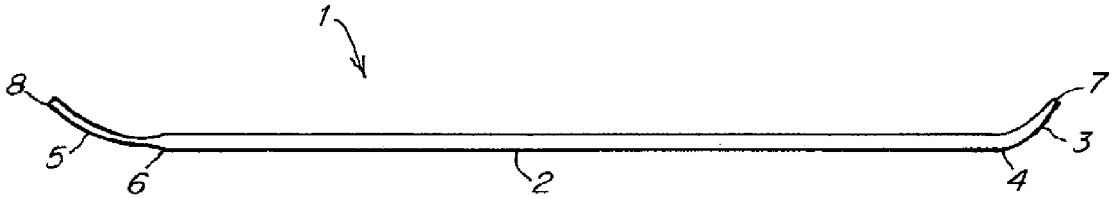
FIG. 7 is a side view of a gliding board comprising a nose and a tail having differing varying bending properties in accordance with one aspect of the invention.

An illustrative embodiment of a gliding board 1 shown in FIG. 1 has a nose 3 and tail 5 at opposite ends of a running length 2. The nose 3 and tail 5 meet respective ends of the running length 2 at a transition, or contact area, shown generally at 4 and 6. At or near a first transition 4, the board 1 transitions from the running length 2 to the upturned nose 3. At or near a second transition 6, the board 1 transitions from the running length 2 to the upturned tail 5. In this illustrative embodiment, the nose 3 has a varying bending property along its length and/or width, resulting in a nose 3 that provides improved lift or float when gliding in certain conditions, such as powder snow. Although the tail 5 in this embodiment does not have a varying bending property, the tail 5 may have varying bending properties similar to that in the nose 3, e.g., the board 1 may have the same float when ridden either nose-first or tail-first (normal or switch). Alternately, the nose 3 may not have varying bending properties and the tail 5 may have such properties. Further, both the nose 3 and the tail 5 may have varying, but differing, bending properties. FIG. 7 shows one embodiment of a gliding board 1 having a nose 3 and a tail 5 with varying bending properties that are different. The nose 3 becomes thinner from near the transition 4 toward the tip 7 of the nose 3. The tail 8 of the board 1 has a thickness that decreases toward the middle of the tail 8 and then increases toward the tip 8. However, the different varying bending property could be achieved in a different way, such as by providing different sizes of holes or grooves in each of the nose 3 and tail 8. In other embodiments, the nose 3 and tail 5 could have entirely different bending properties that vary. In short, any suitable combination of bending properties in the nose 3 and/or tail 5 may be used.

The board 1 may be made to have little or no upturn at the tail 5, and the shape and/or size of the upturn at the nose 3 or tail 5 may be balanced with the bending properties of the nose 3 and/or tail 5. For example, the nose 3 or tail 5 may be curved at a suitable radius and/or arc length to cooperate appropriately with the bending properties of the nose 3 or tail 5 and/or the intended use of the board 1. Of course, the nose 3 and/or tail 5 need not be curved at a single radius. Instead, the nose 3 or tail 5 may have a variable radius, may be approximately straight and arranged at an angle to the running length 2, and so on.

Figure 2:
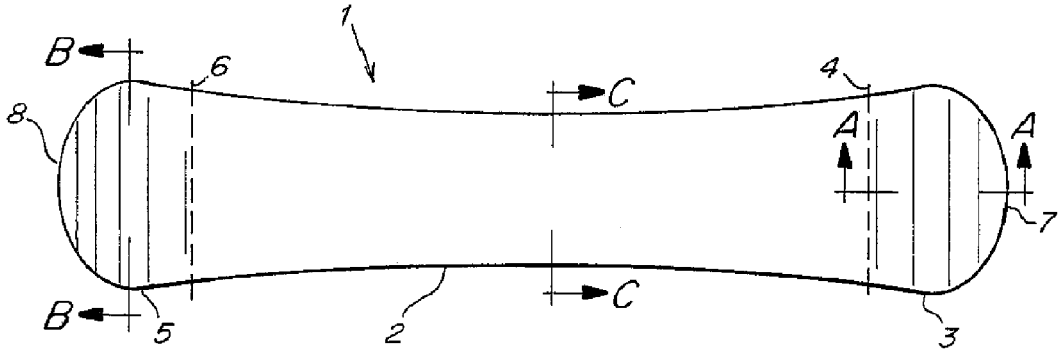
FIG. 2 is a top view of the board of FIG. 1.
Figure 3:
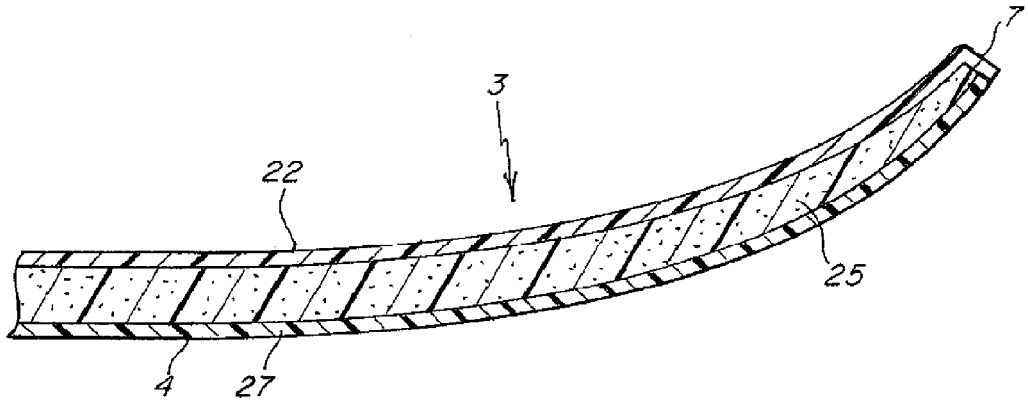
FIG. 3 is a cross-sectional view of the board of FIG. 1 taken along section line A-A shown in FIG. 2.

FIG. 2 shows a top view of the FIG. 1 embodiment, and FIG. 3 shows a cross-section of the nose 3 of the board 1 at the line A-A shown in FIG. 2. In this embodiment, the nose 3 includes a core 25 that tapers, i.e., becomes thinner, from near the transition 4 toward the tip 7 of the nose 3 and is sandwiched between top and bottom reinforcing layers 22 and 27. In one embodiment, the core 25 may taper from a thickness of approximately 2 mm near the transition 4 to approximately 0.8-1 mm near the tip 7. This taper of the core may result in an overall thickness of the nose 3 that is approximately 5-8 mm near the transition 4 and tapers over approximately a 15-20 cm length to approximately 4-7 mm near the tip 7, depending upon the thickness of the top and bottom reinforcing layers 22 and 27, a base, decorative top sheet, or other elements. Of course, the thickness of the core 25 and/or of the nose 3 overall may be varied within any suitable range. In addition as discussed more fully below, the board 1 may be made in any suitable manner using any suitable materials or techniques that are well known in the art. For example, although not shown for clarity, the board 1 may include metal edges around the periphery of the bottom reinforcing layer 27, one or more decorative layers on the top reinforcing layer 22, or a base material or sole under the bottom reinforcing layer 27 to provide a sliding surface. In addition, the core 25 need not extend all the way to the tip 7, but instead may terminate at some point between the transition 4 and the tip 7, or before the transition 4. If the core 25 terminates before the tip 7, another element may be placed between the top and bottom reinforcing layers 22 and 27, e.g., to separate the layers 22 and 27 and provide the nose 3 with varying bending properties.

Figure 8:
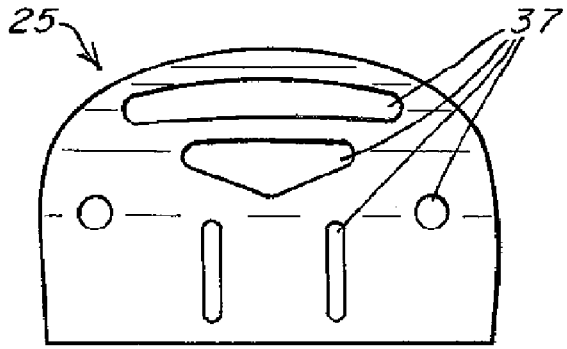
FIG. 8 is a top view of a core having holes in accordance with another aspect of the invention.

Since the core 25 tapers in this embodiment, the overall thickness of the nose 3 also tapers (although not necessarily) and the nose 3 has a varying flexibility from the transition 4 toward the tip 7. That is, in this embodiment, the nose 3 is more flexible near the tip 7 than near the transition 4. As discussed above, the varying bending properties of the nose 3 and/or tail 5 may be provided in any suitable way apart from that shown in this illustrative embodiment. For example, the core 25 may have a constant thickness, or approximately constant thickness, from near the transition 4 to the tip 7, and other portions of the board 1 may be varied in thickness or other properties to provide the varying bending properties. The core 25 or other structural element in the nose 3 may include grooves 39, holes 37 or other physical features, a change in material or material properties or any other suitable feature to provide the desired bending properties, as shown by way of example in FIG. 8. For example, the material type or density of the core 25 or the reinforcing layers 22 and 27 may be varied over the areas of the nose 3 and tail 5. Varying amounts or types of reinforcement fibers or embedded materials, e.g., elastomers, metallic strips or other elements, different types of wood, etc., may be added to the core 25 in different areas to change the local bending properties in the nose 3. The bending properties may also be varied by controlling the amount or type of adhesives used to attach the various layers of the board.

Although the bending properties of the nose 3 or tail 5 preferably include a variation in flexibility from more stiff near the transition to more flexible near the tip, the bending properties may be arranged in other ways. For example, the flexibility of the nose 3 or tail 5 may be high near the transition, drop toward the middle of the nose 3 or tail 5, and then stay constant to the tip, e.g., to prevent breakage of the nose 3 or tail 5. Alternately, the flexibility may be high near the transition, drop near the middle of the nose 3 or tail 5, and then increase toward the tip, e.g., to create a zone in the middle of the nose 3 or tail 5 where a majority of flexing will take place, as shown by way of example in FIG. 7. The bending properties of the nose 3 in the FIG. 1 embodiment are described as varying longitudinally from the transition 4 to the tip 7, but the nose 3 may have varying bending properties in the lateral direction either in addition to, or in place of, varying bending properties in the longitudinal direction. Bending of the nose 3 or tail 5 may be elastic, e.g., to allow a rider to store energy in the nose 3 or tail 5 for various tricks or other maneuvers, or damped to some extent, e.g., to prevent severe vibration of the nose 3 or tail 5.

Figure 4:
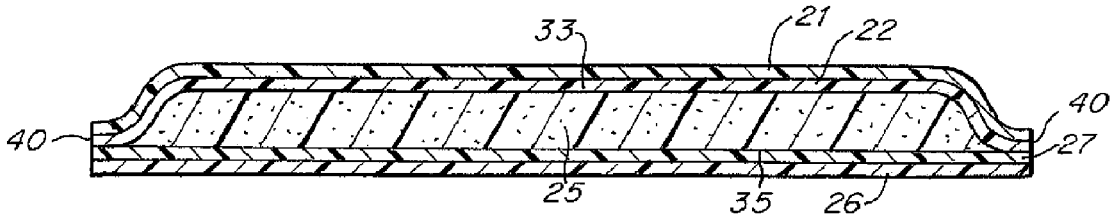
FIG. 4 is a cross-sectional view of the board of FIG. 1 taken along section line B-B shown in FIG. 2.

FIG. 4 shows a cross-sectional view of the board 1 along the line B-B in FIG. 2. In this embodiment, the board 1 has a cap-type construction in the nose 3 and tail 5, and thus the cross-sectional view of the tail 5 at the line B-B is similar to a corresponding cross-sectional view of the nose 3. As is typical with cap-type construction, the top reinforcing layer 22 overlaps the sides of the core 25 and comes in contact with, and is bonded to, the lower reinforcing layer 27. If a metal edge (not shown) is used at the lower edges of the board 1, the top reinforcing layer 22 may be bonded to the metal edge instead of, or in addition to, the bottom reinforcing layer 27. In this configuration, the top reinforcing layer 22 and its attachment to the lower reinforcement layer 27 at edges 40 of the gliding board 1 provide lateral support to the gliding board 1. FIG. 4 also shows a top decorative layer 21 on the top reinforcing layer 22, and a base 26 on the lower reinforcement layer 27. However, these layers are optional, e.g., a decoration may be incorporated into the top reinforcing layer 22, or may be included along with other additional layers, whether structural or decorative. The cap construction in the nose 3 and the tail 5 may extend from the tip 7 or 8 past the transitions 4 and 6 into the running length 2 of the gliding board 1 or terminate in the nose 3 or the tail 5.

While the nose 3 and/or the tail 5 may have a cap construction, at least one portion of one side of the running length of the board 1 includes a sidewall or sidewall construction. In short, the portion of the board 1 having a sidewall construction may have any suitable construction (many of which are well known in the art) that includes a sidewall element that is not covered on a side surface by a top reinforcing layer (e.g., similar to the way the top reinforcing layer wraps over the edge of the core 25 in FIG. 4). The sidewall construction need not be continuous along both sides of the board 1, but rather the board 1 may have several segments having a sidewall that are separated by board portions having other constructions, such as cap construction. For example, the board 1 may have a sidewall construction in separate segments near each foot binding, but have cap construction over other portions of the board 1. Moreover, a sidewall need not be used in at least one portion on both sides of the board 1. Instead, only one side of the board 1 may include one or more sidewall portions.

Figure 5:
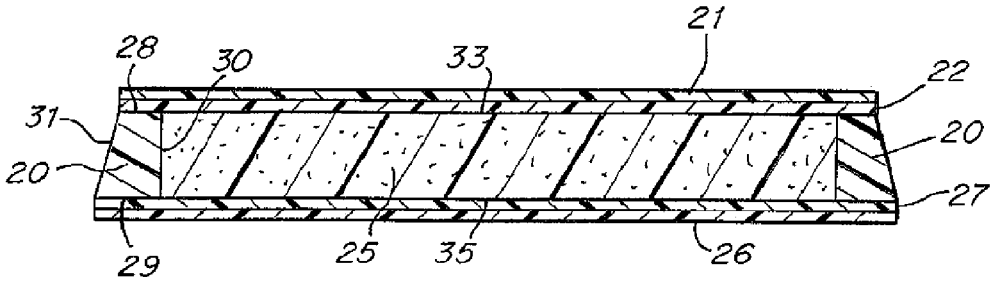
FIG. 5 is a cross-sectional view of the board of FIG. 1 taken along section line C-C shown in FIG. 2.

FIG. 5 shows a cross-section of the illustrative embodiment of the FIG. 1 board at the line C-C shown in FIG. 2. In this illustrative embodiment, the board 1 has sidewalls 20 at both edges of the board 1 that extend along the running length 2 to near the transitions 4 and 6. The portion of the board 1 at the line C-C includes a core 25 made of a suitable material, such as foam, wood, a honeycomb material, a fiberglass/resin matrix, or a molded thermoplastic structure. The core 25 may be made as a one-piece member that extends from the tail 5 to the nose 3, or may include a plurality of portions, e.g., a core portion for the running length and one or more other portions for the nose 3 and tail 5. Along the sides of the board, situated laterally of the core 25, are the sidewalls 20 that provide lateral support to the gliding board 1. The sidewalls 20 have a top surface 28, a bottom surface 29, an interior lateral surface 30 and an exterior lateral surface 31. The exterior lateral surface 31 may be constructed to be perpendicular to the bottom surface 29, or it may form an acute or obtuse angle with the bottom surface 29. In this illustrative embodiment, the exterior lateral surface 31 forms an acute angle with the bottom surface 29. A top reinforcing layer 22 overlays the top surfaces 28 of the sidewalls 20 and the core top surface 33. An optional cosmetic layer 21 overlays the top reinforcing layer 22, and a bottom reinforcing layer 27 is attached to the bottom surfaces 29 of the sidewalls 20 and the core bottom surface 35. A bottom gliding surface 26 is attached to the bottom reinforcing layer 27 and may be formed from a sintered or extruded plastic or other appropriate material. It is to be understood that the invention is in no way limited to the illustrative embodiment described above. Any appropriate arrangement of layers, materials or other elements may be used to form the sidewall portion, or any other portion of the board 1.

Since the board 1 in this illustrative embodiment includes at least one portion with a sidewall construction and a nose 3 and tail 5 having a cap construction, a transition between sidewall construction portions and cap construction portions is made. The transition may take place gradually, e.g., the sidewall 20 may taper or step down in thickness at the transition between sidewall and cap portions. Alternately, the transition may occur abruptly, e.g., the sidewall 20 may be cut off squarely at the ends. The transitions between sidewall and cap construction may occur within the nose 3 and/or tail 5 of the board 1, or within the running length 2 of the board 1.

Figure 6:
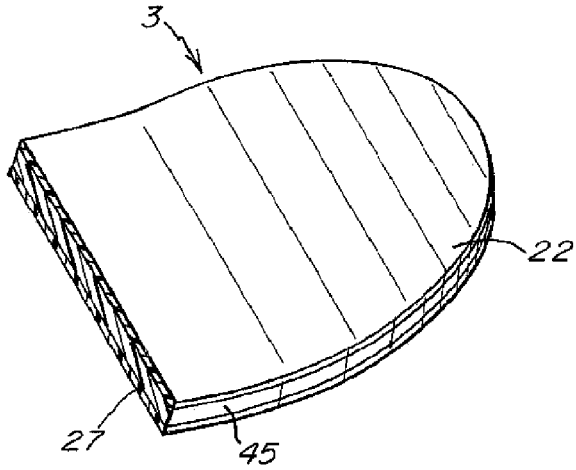
FIG. 6 is a perspective view of a gliding board end having a spacer in accordance with another embodiment.
Figure 9:
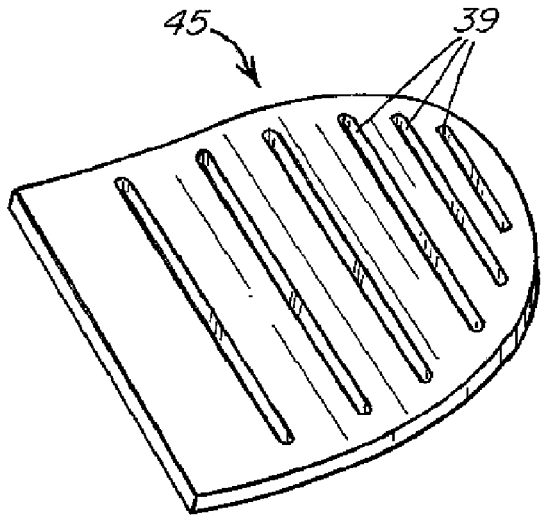
FIG. 9 is a perspective view of a spacer having grooves in accordance with another aspect of the invention.

In lieu of cap construction within the nose 3 and/or tail 5, a sidewall-type construction may be used in the nose 3 or tail 5. Thus, the board 1 may be made to have a sidewall construction throughout. FIG. 6 shows an illustrative embodiment of a nose 3 having a sidewall-type construction. In this embodiment, the nose 3 has a tapered thickness to provide the varying bending properties in the nose 3. As is well known, the core of an all-sidewall construction board typically does not extend into the nose 3 of the board 1. Instead, a spacer 45 (typically a sheet plastic material) is used to separate and bond the top and bottom reinforcing layers 22 and 27. However, in contrast to previously known sidewall-type boards, in this embodiment, the spacer 45 may be tapered, e.g., along the length of the spacer 45, so that the nose 3 tapers between the transition 4 and the tip 7. Alternately, the spacer 45 may be provided with holes, indentations, grooves, slots or other physical features to provide the nose 3 with varying bending properties, as shown by way of example in FIG. 9. As further options for providing the nose 3 with varying bending properties, varying amounts or types of reinforcement fibers or embedded materials may be added to the spacer 45 or other portions of the nose 3 in different areas to change the bending properties.

As discussed above, the gliding board 1 may be made in any suitable way, e.g., similar to that for skis or snowboards. The gliding board 1 may have metal edges, a plastic base material, vertical or horizontal wood laminate core or foam core material, and so on. An exemplary board 1 would include a vertical laminate wood core surrounded by one or more fiber layers for torsional control. A sintered, extruded or graphite base is provided on the snow contacting surface of the board 1 while a plastic, preferably opaque, top sheet for protecting the core and laminate from abrasion and from exposure to ultraviolet light is arranged on the opposite surface. Sidewall or mixed sidewall/cap construction may be employed to protect the core. Stainless steel edges may be included to enhance edge grip. The board 1 may be arranged with a fully distinct nose and tail for directional riding or, instead, with identical shaped tips (and flex patterns) at both ends for matched riding with either the nose or tail forward. The board 1 may have a sidecut for ease of turning the sliding device, and or camber, e.g., to even the contact pressures on the board 1 along the running length. Preferably, the nose and tail are upturned in a shovel arrangement.

The gliding board 1 may be a snowboard that is symmetric or asymmetric about section lines A-A and C-C as shown in FIG. 2, and may be used in combination with any suitable foot bindings 10 to secure a rider's feet to the board 1, as shown by way of example in FIG. 1. For example, a pair of tray snowboard bindings having two or more foot straps, a highback, toe pad and other known elements may be secured to the board 1 in any suitable way, such as by a hold-down disk. Of course, the present invention is not limited to any particular type of binding and/or any other particular elements, as the bindings may be step-in bindings, plate bindings, or any other type of device used to attach a rider's foot to a board 1, whether the rider is wearing soft or hard boots.

Having described particular embodiments of the invention in detail, various modifications and improvements will readily occur to those skilled in the art. Such modifications and improvements are intended to be part of this disclosure and within the spirit and scope of the invention. Accordingly, the foregoing description is by way of example only and the invention is defined by the following claims and their equivalents.

The invention claimed is:

1. A snowboard comprising:

a running length having opposite ends, two sides and having an area for mounting a first snowboard binding and a second snowboard binding, the running length including a core including opposite top and bottom surfaces;

top and bottom reinforcement layers overlying the top and bottom surfaces of the core, the top reinforcement layer being planar in a side-to-side direction across the width of the running length;

a top layer overlying the top reinforcement layer;

a base layer with a gliding surface overlying the bottom reinforcement layer; and first and second sidewalls that extend along lateral sides of the core, each of the first and second sidewalls extending along a substantial height of the core and along the running length;

a nose located at one end of the running length; and a tail located at the other end of the running length, the nose and tail each having a transition end and a tip opposite the transition end, at least one of the nose or tail having an increasing flexibility along a substantial length of the at least one of the nose or tail from the transition end toward the tip, wherein the increasing flexibility is not exclusively the result of a change in width of the at least one of the nose and tail, and wherein the entire running length, nose and tail have a sidewall-type construction.

2. The snowboard of claim 1, wherein a thickness in a portion of the nose or tail decreases between the transition end and the tip.

3. The snowboard of claim 2, wherein a thickness of the nose decreases from approximately 5-8mm near the transition end to approximately 4-7mm near the tip.

4. The snowboard of claim 1, wherein the nose or tail is more flexible near the tip than near the transition end.

5. The snowboard of claim 1, wherein the nose or tail includes a structural element having at least one feature that provides the increasing flexibility.

6. The snowboard of claim 5, wherein the feature includes one of a varying thickness, a hole, a groove, a varying material property, and a change in material.

7. The snowboard of claim 1, wherein the nose and tail each have an increasing flexibility different from each other.

8. The snowboard of claim 1, wherein the nose or tail includes a spacer having a tapering thickness between the top layer and the base layer of the snowboard.

9. A snowboard adapted to cooperate with a pair of snowboard bindings that secure a rider's feet to the snowboard, comprising:

a running length having an area for mounting a first snowboard binding and a second snowboard binding, the running length having two side edges and extending between forward and rear transitions, the running length including a core including opposite top and bottom surfaces;

top and bottom reinforcement layers overlying the top and bottom surfaces of the core, the top reinforcement layer being planar in a side-to-side direction across the width of the running length;

a top layer overlying the top reinforcement layer;

a base layer with a gliding surface overlying the bottom reinforcement layer; and sidewalls that extend along lateral sides of the core, each of the sidewalls extending along a substantial height of the core and along the running length, the entire running length having a sidewall construction with the sidewalls extending over both side edges;

an upturned nose at the forward transition having a transition end and a tip, the nose having a sidewall construction and a varying flexibility along a substantial length of the nose between the transition end and the tip that is not due exclusively to the width of a portion of the nose decreasing between the transition end and the tip; and a tail having a sidewall construction at the rear transition;

wherein the varying flexibility provides improved float in powder snow.

10. The snowboard of claim 9, wherein the nose has a thickness that varies along a length of the nose.

11. The snowboard of claim 9, wherein an overall thickness of the nose decreases from approximately 5-8mm near the transition end to approximately 4-7mm near the tip.

12. The snowboard of claim 9, wherein the core extends from the running length at least partially into the nose, wherein a thickness of the core within the nose decreases between the forward transition and the tip.

13. The snowboard of claim 12, wherein the thickness of the core decreases from approximately 2mm near the forward transition to approximately 1mm near the tip.

14. The snowboard of claim 9, wherein the nose has a continuously increasing flexibility along a substantial length of the nose.

15. The snowboard of claim 9, wherein the nose is more flexible near the tip than near the transition end.

16. The snowboard of claim 9, wherein the nose includes a structural element having at least one feature that provides the varying flexibility.

17. The snowboard of claim 16, wherein the structural element is a spacer, and the feature includes one of a varying thickness, a hole, a groove, a varying material property, and a change in material.

18. The snowboard of claim 9, wherein the nose and tail have a varying flexibility that is different from each other.

19. The snowboard of claim 9, in combination with the two snowboard bindings mounted to the running length of the snowboard.

20. The snowboard of claim 9, wherein the tail is upturned.

21. A method of manufacturing a snowboard having a running length and an upturned nose joined to the running length at a transition, the nose having a tip, comprising:

providing a core constructed and arranged for incorporation into a snowboard, the core having top and bottom surfaces and lateral sides;

providing sidewall elements, a top layer, a top reinforcement layer, a bottom reinforcement layer and a base layer with a gliding surface; and assembling the top layer, the top reinforcement layer, the bottom reinforcement layer, the base layer, the sidewall elements and the core so that (i) the top and bottom reinforcement layers are on opposite top and bottom surfaces of the core with the top layer overlying the top reinforcing layer and the base layer overlying the bottom reinforcing layer, (ii) the sidewall elements are secured along lateral sides of the core along the running length, (iii) a portion of the nose has an increasing flexibility that does not vary solely due to any decrease in width of a portion of the nose between the transition and the tip, and (iv) the snowboard, including the running length and nose, has an all-sidewall construction with the top reinforcing layer being planar in a side-to-side direction across the width of the running length and with each of the sidewall elements extending along a substantial height of the core and along the running length.

22. The method of claim 21, wherein the nose is more flexible near the tip of the nose than near the transition.

23. The method of claim 21, wherein the assembling step includes constructing the nose to have a continuously increasing flexibility to provide improved float in powder snow.

24. The method of claim 21, wherein the step of providing a core comprises providing a core having a nose end that tapers from near the transition toward the nose tip.

25. The method of claim 21, wherein assembling step includes providing a spacer having a tapering thickness that is positioned at the nose between the top and bottom reinforcing layers.

26. A snowboard comprising:

a running length entirely formed with a sidewall construction, the running length including a core including opposite top and bottom surfaces;

top and bottom reinforcement layers overlying the top and bottom surfaces of the core, the top reinforcement layer being planar in a side-to-side direction across the width of the running length;

a top layer overlying the top reinforcement layer;

a base layer with a gliding surface overlying the bottom reinforcement layer: and first and second sidewalls that extend along lateral sides of the core, each of the first and second sidewalls extending along a substantial height of the core and alone the running length; and an upturned nose located at a transition end of the running length, the nose having a tip and a sidewall construction;

the nose including means for providing the nose with a flexibility that varies along a substantial portion of the nose, the means for providing the nose with a varying flexibility being additional to any decrease in the nose width from the transition end to the tip.

27. The snowboard of claim 26, wherein the means for providing provides the nose with a flexibility that increases along a length of the nose between the transition end and the tip.

28. The snowboard of claim 26, wherein the means for providing includes a spacer having a tapering thickness.

* * * * *